US009241523B2

(12) United States Patent
Hendricks

(10) Patent No.: US 9,241,523 B2
(45) Date of Patent: Jan. 26, 2016

(54) PROCESS FOR CONFIGURING A PROTECTIVE HAIR COVERING

(71) Applicant: Katrina Alniece Hendricks, Los Angeles, CA (US)

(72) Inventor: Katrina Alniece Hendricks, Los Angeles, CA (US)

( * ) Notice: Subject to any disclaimer, the term of this patent is extended or adjusted under 35 U.S.C. 154(b) by 115 days.

(21) Appl. No.: 14/145,645

(22) Filed: Dec. 31, 2013

(65) Prior Publication Data

US 2015/0181959 A1 Jul. 2, 2015

(51) Int. Cl.

| | |
|---|---|
| ***A42B 5/00*** | (2006.01) |
| ***A42B 1/06*** | (2006.01) |
| ***A42B 1/04*** | (2006.01) |
| ***A45D 44/12*** | (2006.01) |
| ***A45D 24/00*** | (2006.01) |
| ***A45D 7/02*** | (2006.01) |
| ***A41D 23/00*** | (2006.01) |
| ***A41B 15/00*** | (2006.01) |

(52) U.S. Cl.

CPC ..... *A41D 23/00* (2013.01); *A41B 15/00* (2013.01)

(58) Field of Classification Search

CPC ..... A41B 15/00; A41D 23/00
USPC ..... 2/207, 174; 132/200, 212
See application file for complete search history.

(56) References Cited

U.S. PATENT DOCUMENTS 1,327,062 A * 1/1920 Quinn ..... 2/1
1,906,846 A * 5/1933 Finger ..... 2/91
2,112,774 A * 3/1938 Thorman ..... 2/209.11
2,118,473 A * 5/1938 Morris ..... 206/494
2,121,561 A * 6/1938 English ..... 150/106
2,336,356 A * 12/1943 Harding ..... A42B 1/041 2/195.7
2,665,427 A * 1/1954 Street ..... A42B 1/041 2/174
3,260,292 A * 7/1966 Costello ..... A41D 23/00 2/200.3
3,380,076 A * 4/1968 Held ..... 2/207
3,480,970 A * 12/1969 Gettinger ..... A42B 1/045 2/171
3,618,140 A * 11/1971 Goldfarb ..... 2/207
4,788,722 A * 12/1988 Oliver ..... 2/207
4,790,035 A * 12/1988 Whyte ..... A42B 1/041 2/207
4,993,080 A * 2/1991 Doty ..... A41D 23/00 2/181
5,058,211 A * 10/1991 Hanks ..... 2/206
5,083,318 A * 1/1992 Hook ..... A42B 1/041 2/174
5,636,384 A * 6/1997 Draughon ..... D04D 7/10 2/151

(Continued)

*Primary Examiner* — Clinton T Ostrup
*Assistant Examiner* — Cameron A Carter
(74) *Attorney, Agent, or Firm* — Plager Schack LLP

(57) ABSTRACT

A process for forming a protective hair covering includes the following steps. First, folding a fabric section into a triangle. Next, wrapping a first side of the triangle around the back of a user's head. Then, folding the triangle along two fold lines to create two tie segments in addition to a corner of the triangle forming a third tie segment. After that, tying the first tie segment and the second tie segment into a first knot in front of the third tie segment twice. Then, folding the first tie segment into a first bow. After that, folding the second tie segment into a second bow. Then, tucking and tacking the third tie segment into a third bow. The first bow, the second bow and the third bow give an appearance of a flower.

3 Claims, 4 Drawing Sheets

(56) References Cited

U.S. PATENT DOCUMENTS 6,353,937 B1 * 3/2002 Martindale ..... A42B 1/041 132/200
7,096,510 B2 * 8/2006 Yeadon ..... 2/202
7,200,874 B2 * 4/2007 Leguenec ..... A42B 1/041 132/58
7,836,523 B2 * 11/2010 Castle ..... A41G 5/0093 2/174
8,074,296 B1 * 12/2011 Leung ..... A42B 1/225 2/172
2004/0055079 A1 * 3/2004 Haaga ..... A62B 17/006 2/455
2005/0278830 A1 * 12/2005 Hokin ..... A42B 1/041 2/207
2006/0005297 A1 * 1/2006 Blecha ..... 2/207
2006/0178249 A1 * 8/2006 Pastor Serra ..... 493/162
2008/0148466 A1 * 6/2008 Wohl ..... 2/209.3
2008/0209614 A1 * 9/2008 Beausang ..... 2/207
2008/0295221 A1 * 12/2008 Grey ..... 2/174
2009/0126078 A1 * 5/2009 Rashid ..... 2/207
2009/0241241 A1 * 10/2009 Bailey ..... 2/202
2012/0066812 A1 * 3/2012 Alzate ..... 2/159
2012/0079644 A1 * 4/2012 Benderradji ..... 2/207
2012/0117712 A1 * 5/2012 Fleming ..... 2/207
2012/0210492 A1 * 8/2012 Bielobocky ..... 2/207
2012/0216333 A1 * 8/2012 Dewese ..... 2/207

* cited by examiner

PROCESS FOR CONFIGURING A PROTECTIVE HAIR COVERING

BACKGROUND

The embodiments herein relate generally to personal accessories.

Prior to embodiments of the disclosed invention, hair coverings easily came apart and had to be restyled with each use. Embodiments of the disclosed process solve this problem.

SUMMARY

A process for forming a protective hair covering that covers an anterior fontanelle and a posterior fontanelle on a human head has the following steps, which are not necessarily in order. First, folding a fabric section, having an original shape, along a first fold line into a triangle comprising a first corner, a second corner, a third corner, a first side, a second side, a third side and a centroid. Next, wrapping the first side around the posterior fontanelle and configuring the centroid proximate the anterior fontanelle. After that, folding the triangle along a second fold line extending perpendicular from the first side creating a first tie segment. Then, folding the triangle along a third fold line extending perpendicular from the first side creating a second tie segment. Following that, forming a third tie segment with a portion of the fabric section proximate the second corner. Next, tying the first tie segment and the second tie segment into a first knot in front of the third tie segment. Then, lifting the third tie segment over the first knot. After that, tying the first tie segment and the second tie segment into a second knot in front of the third tie segment. Then, folding the first tie segment into a first bow. Following that, folding the second tie segment into a second bow. Finally, tucking and tacking the third tie segment into a third bow. The first bow, the second bow and the third bow give an appearance of a flower.

In some embodiments, the original shape can be a quadrilateral. The second fold line can be proximate a left ear on the human head. Likewise, the third fold line can be proximate a right ear on the human head.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
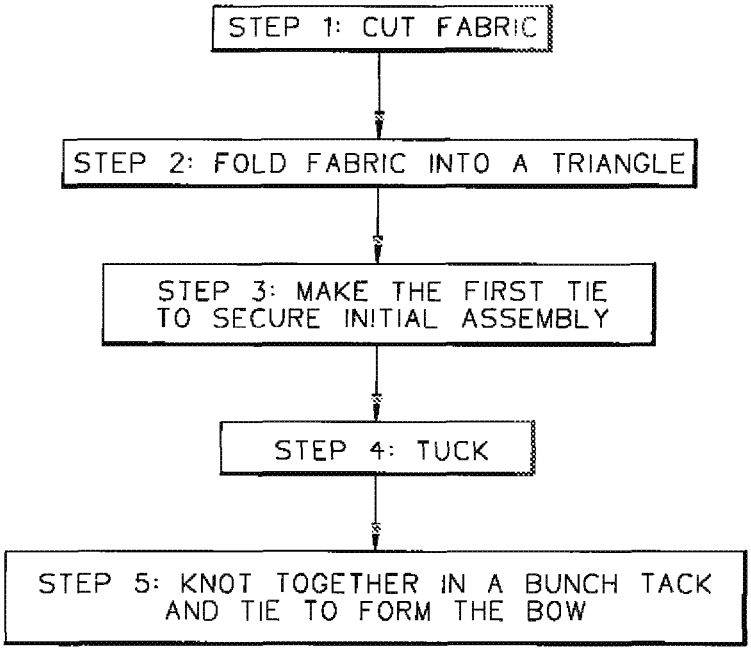
FIG. 1 is a schematic view of the invention assembly steps.

By way of example, and referring to FIG. 1, one embodiment of the present process comprises the following steps, not necessarily in order. First, folding a fabric section into a triangle. Next, wrapping a first side of the triangle around the back of a user's head. Then, folding the triangle along two fold lines to create two tie segments in addition to a corner of the triangle forming a third tie segment. After that, tying the first tie segment and the second tie segment into a first knot in front of the third tie segment twice. Then, folding the first tie segment into a first bow. After that, folding the second tie segment into a second bow. Then, tucking and tacking the third tie segment into a third bow. The first bow, the second bow and the third bow give an appearance of a flower. As used in this application, "tacking" means sealing with a single stitch.

Figure 2:
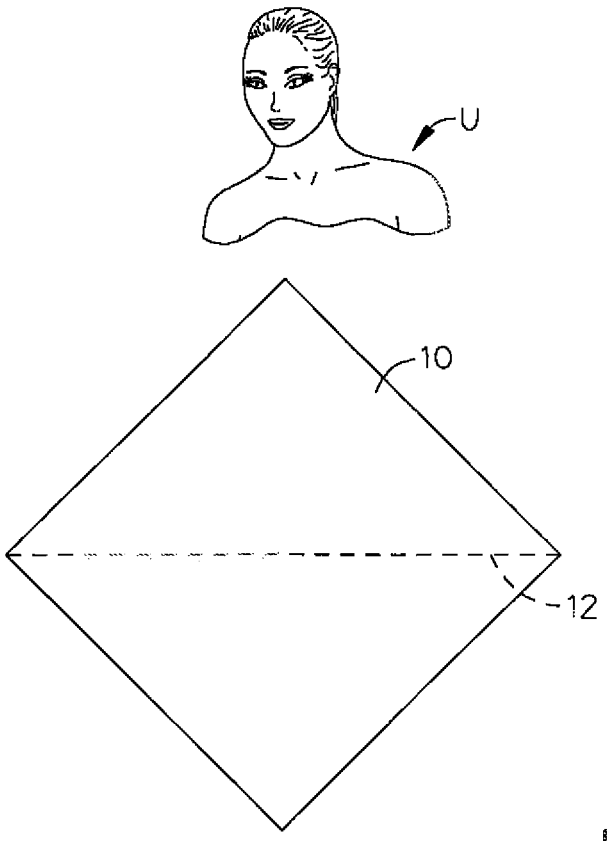
FIG. 2 is a front view of a portion of an embodiment of the invention.

Turning to FIG. 2, user U is shown proximate fabric section 10 having an original shape, which is shown to be a quadrilateral. In some embodiments, other shapes can be used provided the shape can be readily folded into a triangle. For instance fabric section 10 is folded along first fold line 12 to form a triangle as shown in FIG. 3.

Figure 3:
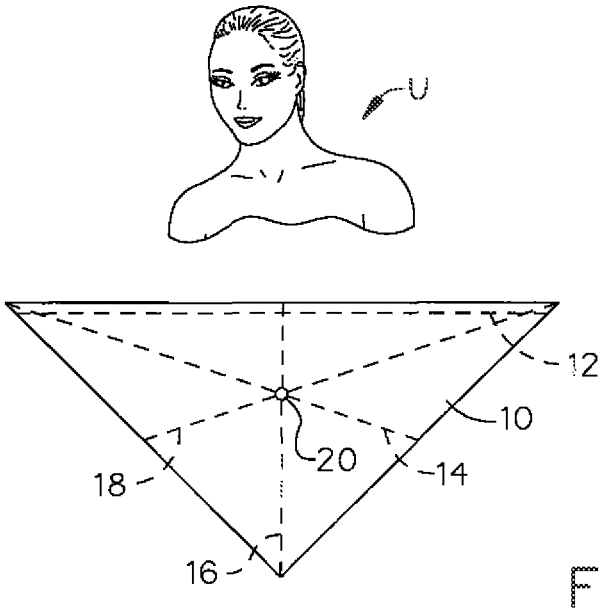
FIG. 3 is a front view of a portion of an embodiment of the invention.

As shown in FIG. 3, the triangle has three sides and three corners as is well known. First center line 14 is drawn from the first corner to the middle of the third side. Second center line 16 is drawn from the second corner to the middle of the first side. Third center line 18 is drawn from the third corner to the middle of the second side. The cross section of first center line 14, second center line 16 and third center line 18 is centroid 20, which is used to align the triangle as shown in FIG. 4.

Figure 4:
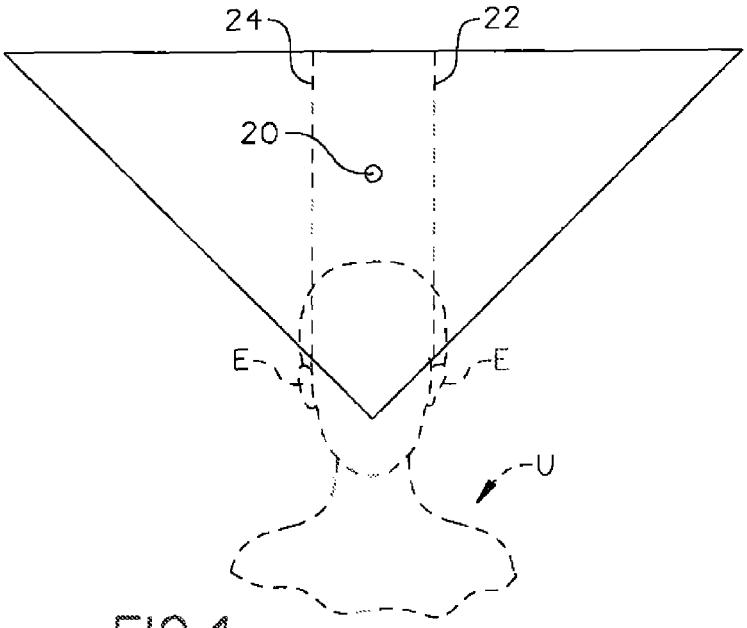
FIG. 4 is a front view of a portion of an embodiment of the invention.

As shown in FIG. 4, User U has left ear E and right ear E, which are shown for geometric alignment purpose. Users U also has a human head which comprises a pair of frontal bones separated by a frontal suture which extend backward to the anterior fontanelle immediately adjacent to the parietal bones and then to the posterior fontanelle as is well known in human anatomy.

The triangle should extend sufficiently far backward such that the first side wraps around the posterior fontanelle and the centroid is at, or slightly in back of, the anterior fontanelle. When aligned in this manner second fold line 22 extends perpendicular from the first side through left ear E. Likewise, third fold line 22 extends perpendicular from the first side through right ear E.

Figure 5:
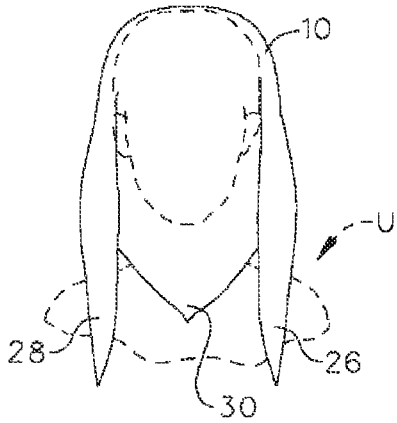
FIG. 5 is a front view of a portion of an embodiment of the invention.

Turning to FIG. 5, when the triangle is folded along third fold line 22, first tie segment 26 is formed. Likewise, when the triangle is folded along third fold line 22, first tie segment 26 is formed. This causes a portion of material proximate the second corner to hang as third tie segment 30.

Figure 6:
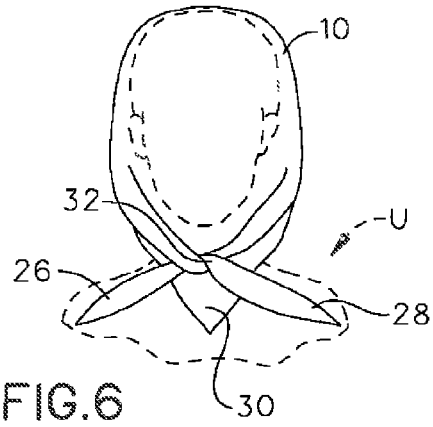
FIG. 6 is a front view of a portion of an embodiment of the invention.

As shown in FIG. 6, first tie segment 26 and second tie segment 28 are tied into knot 32 in front of third tie segment 30. In this application, that is called tying. Excess fabric from the triangle can be folded around the head of user U. In this application, that is called tacking.

Figure 7:
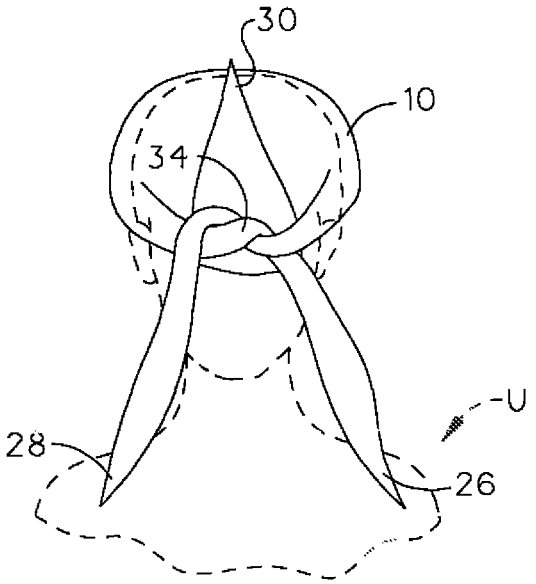
FIG. 7 is a front view of a portion of an embodiment of the invention.

Turning to FIG. 7, third tie segment 30 is lifted over knot 32. Then first tie segment 26 and second tie segment 28 are tied into a second knot 34. In some embodiments, first knot 32 and second knot 34 are configured to be above the eyes of user U enabling user U to see.

Figure 9:
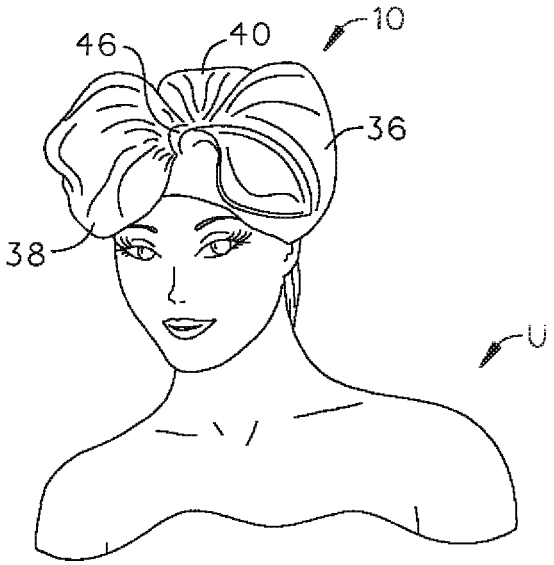
FIG. 9 is a perspective view of an embodiment of the invention shown in use.
Figure 8:
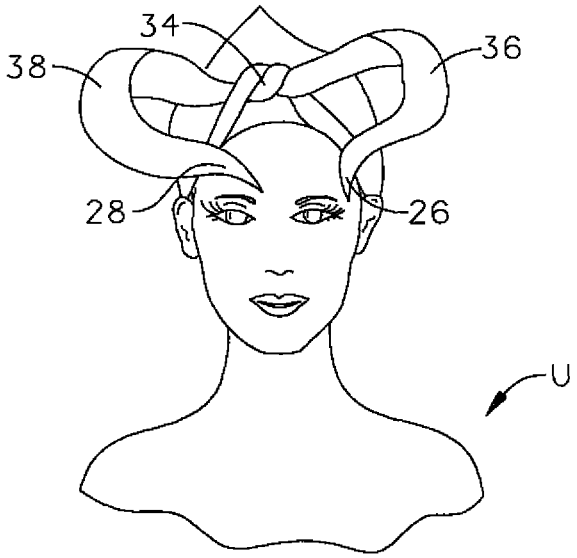
FIG. 8 is a front view of a portion of an embodiment of the invention.

As shown in FIG. 8, once second knot 34 is tied, first tie segment 26 is folded into first bow 36. Likewise, second tie segment 28 is folded into second bow 38. At the same time third tie segment 30 is inserted into second knot 34 creating the appearance of third bow 40. The bows are then tied together and tacked as shown in FIG. 9 giving an appearance of a flower and completing the protective hair covering. Finally, stitch 46 is tacked through knot 32, knot 34, and third bow 40 holding fabric section 10 in place.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A process for forming a protective hair covering that covers an anterior fontanelle and a posterior fontanelle on a human head; the process comprising: folding a fabric section, shaped as a quadrilateral, along a first fold line into a triangle comprising a first corner, a second corner, a third corner, a first side, a second side, a third side and a centroid; wrapping the first side around the posterior fontanelle and configuring the centroid proximate the anterior fontanelle; folding the triangle along a second fold line extending perpendicular from the first side creating a first tie segment; folding the triangle along a third fold line extending perpendicular from the first side creating a second tie segment; forming a third tie segment with a portion of the fabric section proximate the second corner; tying the first tie segment and the second tie segment into a first knot in front of the third tie segment; lifting the third tie segment over the first knot; tying the first tie segment and the second tie segment into a second knot in front of the third tie segment; folding the first tie segment onto itself and into a first bow; folding the second tie segment onto itself and into a second bow; tucking the third tie segment upward and tacking the third tie segment onto itself and into a third bow; inserting a stitch through the first knot, the second knot and the third bow; wherein the first bow, the second bow and the third bow give an appearance of petals forming a flower.

2. The process of claim 1, wherein the second fold line is adapted to be proximate a left ear on the human head.

3. The process of claim 2, wherein the third fold line is adapted to be proximate a right ear on the human head.

* * * * *